US007823609B2

(12) United States Patent
Wonders

(10) Patent No.: US 7,823,609 B2
(45) Date of Patent: Nov. 2, 2010

(54) METHOD AND APPARATUS FOR FILLING A PLURALITY OF AIR BREATHING TANKS USED BY FIREMEN AND SCUBA DIVERS

(76) Inventor: Scott F. Wonders, 3119 59th St., Port Arthur, TX (US) 77640

( * ) Notice: Subject to any disclaimer, the term of this patent is extended or adjusted under 35 U.S.C. 154(b) by 1204 days.

(21) Appl. No.: 11/436,750

(22) Filed: May 17, 2006

(65) Prior Publication Data

US 2008/0023100 A1 Jan. 31, 2008

(51) Int. Cl.
*B65B 31/00* (2006.01)
*B65B 3/04* (2006.01)

(52) U.S. Cl. ..... 141/2; 141/4; 141/18; 141/197; 141/237

(58) Field of Classification Search ..... 141/1, 141/2, 4, 197, 237, 238, 18, 97
See application file for complete search history.

(56) References Cited

U.S. PATENT DOCUMENTS 2,469,434 A * 5/1949 Hansen et al. ..... 141/3
4,862,931 A * 9/1989 Vella ..... 141/237
5,409,046 A * 4/1995 Swenson et al. ..... 141/197
5,458,167 A * 10/1995 Schultz et al. ..... 141/197
5,513,678 A * 5/1996 Schultz et al. ..... 141/4
5,529,096 A * 6/1996 Rowe et al. ..... 141/197
5,570,685 A * 11/1996 Turiello ..... 128/202.13
5,858,064 A * 1/1999 Delp, II ..... 95/12
5,884,675 A * 3/1999 Krasnov ..... 141/18
6,152,192 A * 11/2000 Klotz et al. ..... 141/197
6,786,245 B1 * 9/2004 Eichelberger et al. ..... 141/4
7,168,428 B1 * 1/2007 Zoha ..... 128/202.27
7,249,617 B2 * 7/2007 Musselman et al. ..... 141/231
7,415,995 B2 * 8/2008 Plummer et al. ..... 141/197
7,578,292 B2 * 8/2009 Musselman et al. ..... 141/95

* cited by examiner

*Primary Examiner*—Gregory L Huson
*Assistant Examiner*—Nicolas A Arnett
(74) *Attorney, Agent, or Firm*—The Matthews Firm

(57) ABSTRACT

A source of compressed air, such as one or more air compressors and/or one or more tanks of compressed air, is used to sequentially fill a plurality of compressed air storage cylinders. A plurality of pressure-sensitive, one way check valves cause the storage cylinders to be automatically filled up, one at a time, in a determined sequence. The outputs of the storage cylinders are connected through a plurality of differential air pressure valves to a fill station, to cause the storage cylinders to fill up individual air breathing tanks, in which the storage cylinders are depleted in a determined sequence, one at a time. By depleting first the first to be filled storage cylinder, first in—first out, the same filling procedure can be used to refill the air storage cylinders.

14 Claims, 4 Drawing Sheets

METHOD AND APPARATUS FOR FILLING A PLURALITY OF AIR BREATHING TANKS USED BY FIREMEN AND SCUBA DIVERS

FIELD OF INVENTION

This invention relates, generally, to improved methods and apparatus for refilling a plurality of compressed air tanks used by firemen, while in, at or near burning structures, and which can also be used for refilling one or more compressed air tanks for use by SCUBA divers and others requiring such air tanks.

It is well-known in the art of firemen going near or into a burning structure, to use a tank of compressed air on their backs, which air is then breathed by the firemen after passing through a conventional regulator, located between the tank of compressed air and the fireman's mouth. This conventional regulator device reduces the pressure of the air to be breathed down to an acceptable level.

Such regulators are also used by SCUBA divers to reduce the pressure of the compressed air down to an acceptable level for use by such divers.

It is also well-known that such compressed air tanks will generally be depleted after a period of time, depending on use and must then be refilled with compressed air to allow their continued use.

The present invention provides new and improved methods and apparatus for optimizing the refilling of such tanks with compressed air.

DETAILED DESCRIPTION OF PREFERRED EMBODIMENTS OF THE INVENTION

Figure 1:
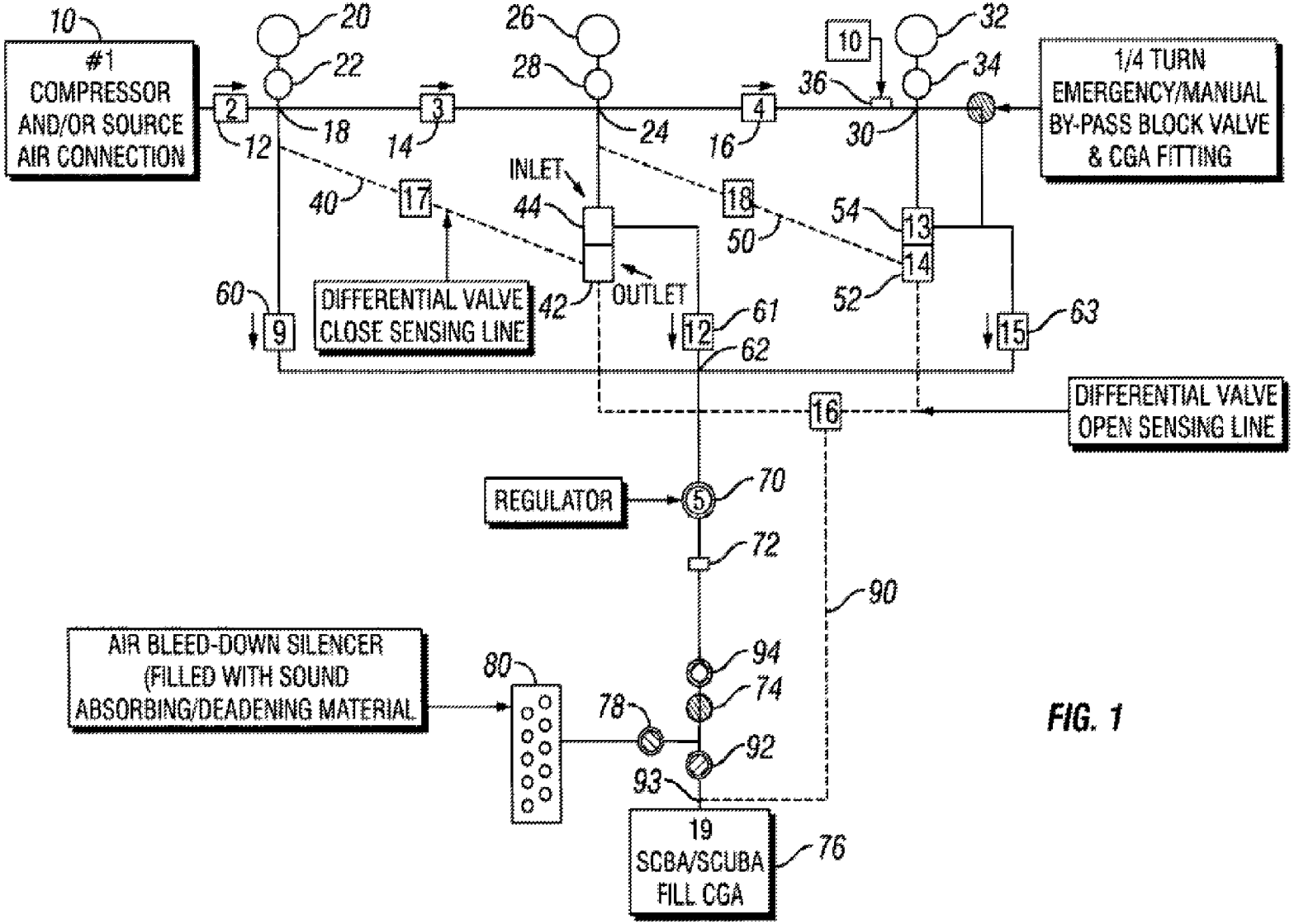
FIG. 1 is a block diagram of a first embodiment of the invention.

Referring now to the drawings in more detail, FIG. 1 illustrates a source 10 of compressed air which is used as a source for filling a plurality of compressed air cylinders which can be used to supply air for use by firemen in burning structures, and can also be used to supply air for use by SCUBA divers. The source 10 may be of various sizes and configurations, but typically will be one or more air compressors and/or one or more high volume, high pressure compressed air tanks. The source 10 is connected through, in succession, a first one-way check valve 12, a second one-way check valve 14 and a third one-way check valve 16. To the junction 18 between the check valves 12 and 14, a first compressed air storage cylinder 20 is connected to allow the cylinder 20 to be filled with additional compressed air from the source 10, as monitored by pressure gauge 22. Similarly, a junction 24 between the check valves 14 and 16 allows a second compressed air storage cylinder 26 to be filled with additional compressed air, as monitored by pressure gauge 28.

In a similar manner, a junction 30 connected to the output of check valve 16 allows a third compressed air storage cylinder 32 to be filled with additional compressed air, as monitored by pressure gauge 34. A pressure relief valve 36 will relieve the air pressure from junction 30 once such pressure reaches a pre-determined level, thereby preventing the overpressuring of the storage cylinders 20, 26 and 32.

In the operation of the system of FIG. 1 so far described, the source 10, for example, a conventional 10 CFM compressor, will first begin refilling the lowest pressure cylinder 20. This ability to fill the cylinder 20 before filling the cylinder 26 or the cylinder 32, is accomplished because of using the check valve 14. Check valve 14 is set to allow air flow only when the air pressure is higher on its input side than the air pressure on its output side, normally set to open upon there being a pressure differential of 0-5 psi. For example, if cylinder 20 has a pressure of 1000 psi and cylinder 26 has a pressure of 2000 psi, turning on the compressor 10 will start to fill up only the cylinder 20, and will continue to fill up only the cylinder 20 until cylinder 20 has a pressure of between 2000 and 2005 psi. At this time, the check valve 14 will open, and the cylinders 20 and 26 will begin to fill at the same rate. Each of the check valves 12, 14, 16, 60, 61, and 63 function in that same manner. Because of the check valves 12, 14 and 16, the air flow beginning at the source 10 will flow sequentially through the check valves 12, 14 and 16, as shown by the arrows above those three valves 12, 14 and 16. As the air pressure in storage cylinder 20 increases to equalize with the air pressure in storage cylinder 26, the storage cylinders 20 and 26 will begin to fill at an equal rate. As the pressure in cylinders 20 and 26 increases to equalize with the air pressure in cylinder 32, the cylinders 20, 26 and 32 will begin to all be filled at the same rate.

It should be appreciated that although there are three storage cylinders 20, 26 and 32 illustrated and described in FIG. 1, the invention contemplates the use of two, four or more of such storage cylinders and a corresponding number of check valves to achieve the amount of compressed air as needed.

Moreover, the check valves 12, 14 and 16 prevent a higher pressure storage cylinder from equalizing its pressure down to that of a lower pressure storage cylinder. Thus, for example, if storage cylinder 20 has an air pressure of 1000 psi and storage cylinder 26 has an air pressure of 4000 psi, the omission, or bypass of the check valve 14 would allow the equalization of the air pressure in cylinders 20 and 26 at a level below the 4000 psi figure. This equalization of pressure is generally undesirable, because it is known in this art that most air compressors have CFM (cubic feet per minute) recovery rates which are higher at lower pressures.

Referring again to FIG. 1, the junction 18 is connected via a differential valve close sensing line 40 to a differential pressure valve 42 having a nominal 60-100 psi bias. The junction 24 is connected via a differential valve closing line 50 to a differential pressure valve 52, and also to the toggle air valve 44. The junction 30 is connected to the input of a toggle air valve 54. The junction 18 is connected via a one-way check valve 60 to a junction 62. The outlets of the toggle valves 44 and 54 are also connected through check valves 61 and 63, respectively, to the junction 62.

The junction 62 is connected through a pressure regulator 70 and a pressure relief valve 72 to a bleed and block valve 74, which in turn allows an individual user's tank to be filled at 76, or which allows the bleed down of the air thorough the bleed valve 78 to cause the air to be released through an air silencer 80, filled with sound absorbing/deadening materials. A pair of pressure gauges 92, for monitoring SCBA/SCUBA pressure, and 94, for monitoring regulated pressure, can be used on opposite sides of block bleed valve 74.

A differential valve open sensing line is connected between each of the differential valves 42 and 52, and the junction 93 between the bleed and block valve 74 and the individual air tanks 76.

In the operation of this system above-described, the differential pressure valve 42 is connected between the pressure in line 40 and the pressure in line 90. When the pressure in line 40 is approximately 80 psi greater than the pressure in line 90, a piston in valve 42 will move down, which causes the toggle valve 44 to close. In a similar manner, if the pressure in line 50 is approximately 80 psi greater than the pressure in line 90, the toggle valve 54 will close.

In using the cascade system described herein to refill one or more individual tanks, the air stored in cylinder 20 is present along line 40, and because line 90 has zero pressure, the toggle valve 44 will close and not allow the stored air in cylinder 26 to be used. Likewise, the toggle valve 54 will be closed, and thus will not allow the air stored in cylinder 32 to be used. Because valves 44 and 54 are closed, the storage cylinder 20 is thus automatically used to refill an individual tank at location 76. Once the air in storage cylinder 20 is depleted to a pressure approximately 80 psi higher than the pressure on line 90, the valve 44 is no longer closed, allowing the storage cylinder 26 to be used to fill up the individual tanks at location 76.

In a similar manner, once the air in cylinder 26 is depleted to a pressure approximately 80 psi higher than the pressure of line 90, the valve 54 is no longer closed allowing the cylinder 32 to be used to fill up the individual tanks at location 76.

It should be appreciated that the back-filling of the storage cylinders 20, 26 and 32 can be done simultaneously with the refilling of individual user tanks at location 76, in accord with the present invention.

Example of Use for the System According to the Invention

| | |
|---|---|
| Recharge SCBA/SCUBA cylinders pressure: | 1000 psi |
| Storage cylinder 20 pressure: | 1800 psi |
| Storage cylinder 26 pressure: | 3000 psi |
| Storage cylinder 32 pressure | 6000 psi |

When recharge SCBA/SCUBA cylinder is attached to the fill whip 76 and SCBA/SCUBA cylinder valve is opened, pressure (1000 psi) from the SCBA/SCUBA cylinder is transferred to line 90 which in turn applies this pressure to the lower section of valves 42 and 52. Pressure from cylinder 20 (1800 psi) is transferred to the upper section of valve 42 and pressure from cylinder 26 (3000 psi) is transferred to the upper section of valve 52.

Since the pressures on the upper sections of valves 42 and 52 are greater than the pressure on the lower sections of these valves, the internal pistons of these valves are forced downward holding toggle valves 44 and 54 in the closed position. This will permit compressed air from cylinder 20 only to flow into the SCBA/SCUBA recharge cylinder at location 76.

The pressure in cylinder 20 and the recharge SCBA/SCUBA at location 76 begins to equalize. When these pressure come to approx 80 psi of equalization (Approx 1720 psi), valve 42 is forced upward (with the assistance of a 60 to 80 psi spring) and toggle valve 44 is forced open. This will permit air from cylinder 26 to flow into the SCBA/SCUBA recharge cylinder at location 76. Check valve 60 will keep higher pressure air from cylinder 26 or the SCBA/SCUBA recharge cylinder at location 76 from flowing back into cylinder 20.

Next the pressure in cylinder 26 and the recharge SCBA/SCUBA at location 76 begins to equalize. When these pressures come to approx 80 psi of equalization (Approx 2220 psi), valve 52 is forced upward (with the assistance of a 60 to 80 psi spring) and toggle valve 54 is forced open. This will permit air from cylinder 32 to flow into the SCBA/SCUBA recharge cylinder at location 76. Check valves 60 and 61 will keep higher pressure air from cylinder 26 or the SCBA/SCUBA recharge cylinder at location 76 from flowing back into cylinder 20 or cylinder 26.

NOTE 1: Check valve 63 keeps pressure from the recharge SCBA/SCUBA cylinder at location 76 from back flowing/equalizing with cylinder 32 should the pressure in the recharge cylinder at location 76 be greater then that of cylinder 32.

NOTE 2: Since line 90 transfers pressure from downstream of the regulator 70, valves 44 and 54 can open only if the pressure on line 90 and 40 or 50 is/are below the pressure setting of the regulator 70. Basically, this means that valves 44 and 54 will remain closed if the SCBA/SCUBA recharge cylinder at location 76 reaches the regulator 70 set recharge pressure using only cylinder 20. Valve 54 will remain closed if the SCBA/SCUBA recharge cylinder at location 76 reaches the regulator 70 set recharge pressure using only cylinder 26.

NOTE 3: Manual/Emergency By-pass Valve 33, is to be used in the event of an internal valve failure or for air sampling purposes. Opening this valve converts the cascade system to bulk storage. This means that pressure in all storage cylinders 20, 26 and 32 will equalize with that of the recharge SCBA/SCUBA cylinder at location 76 beginning with the highest pressure storage cylinder NOTE 4: These pressure are used for examples only. Actual pressures will decrease as the recharge SCBA/SCUBA cylinders at location 76 are filled. The amount of decrease will depend on storage cylinders and recharge cylinder volume. Example: A 30 minute high pressure SCBA cylinder being filled using the above pressures may result in the following pressures. Cylinder 20 may drop to approx. 1300 psi. Cylinder 26 may drop to 2700 psi. Cylinder 32 may drop to 5800 psi.

Figure 2:
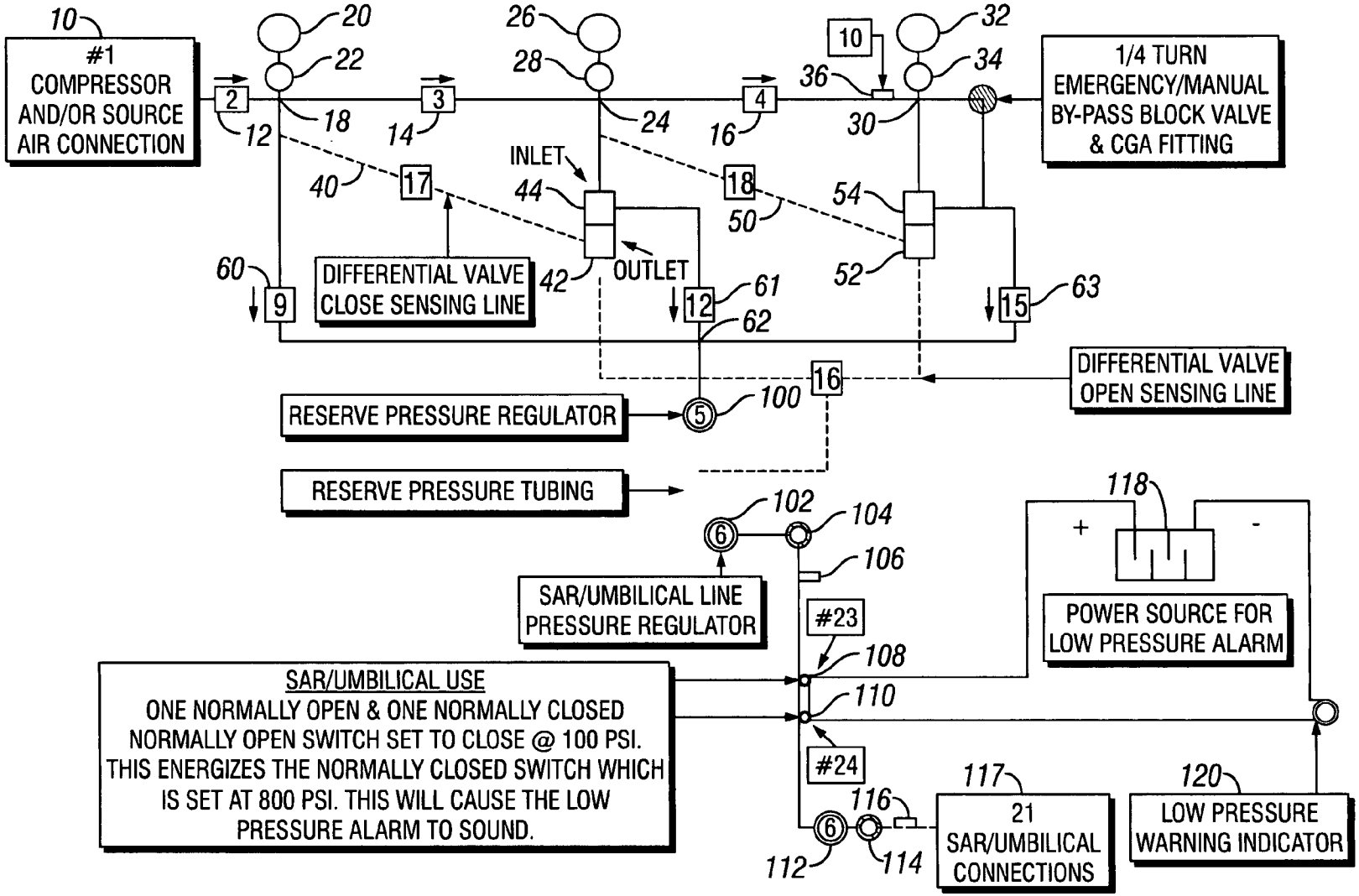
FIG. 2 is a block diagram of a second embodiment of the invention.

Referring now to FIG. 2, there is illustrated an alternative embodiment of the invention, from that illustrated and described with respect to FIG. 1. FIG. 2 uses the automatic cascading system of FIG. 1, but has the differential valve open sensing line 90 sensing the air pressure between a reserve pressure regulator 100 and a supplied air respirator (SAR)/umbilical pressure regulator 112. The output of regulator 100 is connected through a pressure gauge 104 and a pressure relief valve 106, to a normally open pressure switch 108 and a normally closed pressure switch 110. The switch 108 is set to close at a nominal pressure of 100 psi. The switch 110 is set to open at a nominal pressure of 800 psi. The pressure switches 108 and 110 are connected in series with a pressure regulator 112, which in turn is connected through a pressure gauge 114 and a pressure relief valve 116 to the SAR/umbilical connection 117. A low pressure system having a power source 118 and a low pressure warning indicator 120 is connected across the switches 108 and 110.

The switch 108 is normally open, and will not close until the pressure is 100 psi or greater. When closed, switch 108 arms the low pressure alarm system which opens the switch 110. When the pressure out of regulator 102 drops below 800 psi, the switch 110 closes and the low pressure warning device 120 will sound. The low pressure warning device 120 can be electrically, pneumatically, hydraulically, or mechanically operated, or a combination thereof.

In operation of the system according to FIG. 2, it should be appreciated that the CAMS auto cascading system of the SAR system in FIG. 2 functions identically to that described in FIG. 1 with the exception that the differential valve open sensing line 90 monitors and transfers the pressure from between regulators 101 and 102. This enables the system to be able to custom set the pressure at which the CAMS switches the various functions between the storage cylinders 20, 26 and 32.

Example: Set the reserve pressure of regulator 100, to a value of 1500 psi.

When storage cylinder 20 pressure reaches 1580 psi, valve 44 opens. Since the pressure in cylinder 26 is higher then that of cylinder 20, check valve 60 will close and cause only the compressed air from cylinder 26 to flow downstream through the pressure tubing and supply pressure for the reserve pressure regulator 100.

When the storage cylinder 26 pressure reaches 1580 psi, valve 54 opens. Since the pressure in cylinder 32 is higher than that of cylinders 20 and 26, check valves 60 and 61 will close and permit only gas/pressure from cylinder 32 to flow downstream through the pressure tubing and supply pressure for the reserve pressure regulator 100.

NOTE #2: All pressure in storage cylinders that is below the reserve pressure regulator 100 is available for use by the system if:

#1—The reserve pressure regulator is adjusted to a pressure lower then that of the pressure available in the storage cylinder 20.

#2—The overall system pressure drops below the setting of the reserve pressure regulator 100.

#3—The Emergency/Manuel By-Pass Valve 33 is opened.

1—Adjusting the CAMS Reserve Pressure Regulator 100, to 1000 psi. (or minimum reserve psi required/desired).

2—Final line pressure to the SAR/Umbilical at location 117 is controlled by the SAR/Umbilical pressure regulator 102.

3—The low pressure alarm is armed as pressure switch 108 (normally open) closes when minimum pressure rises above 100 psi. This configuration is used to automate arming of the system. (In place of a manual off-on switch)

4—This energizes pressure switch 110 (Normally closed) which will close when minimum pressure drops below 800 psi.

Figure 3:
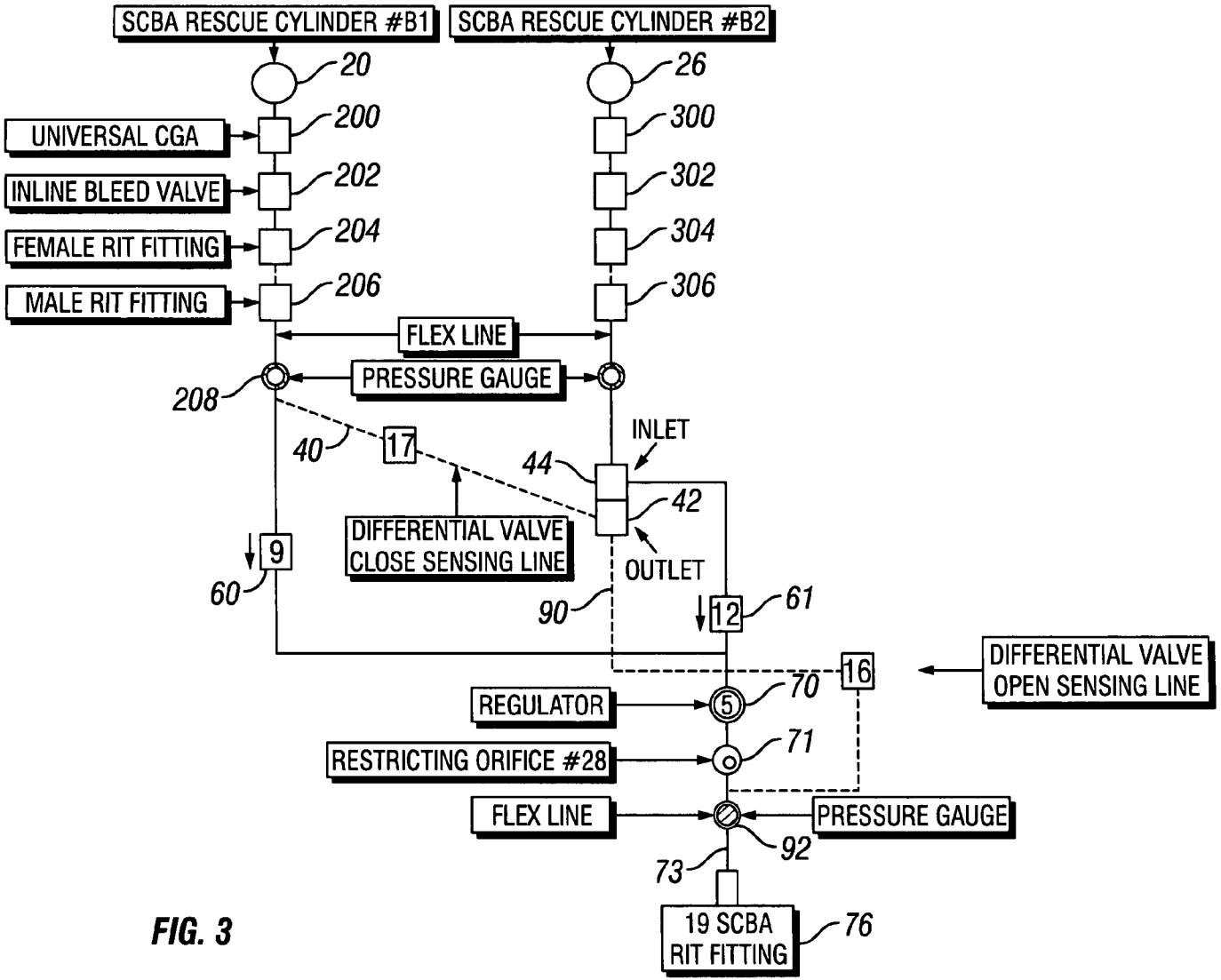
FIG. 3 is a block diagram of a third embodiment of the invention.

Referring now to FIG. 3, there is illustrated a Rapid Intervention Team (RIT) rescue cascade system, for use, typically, in rescuing firemen trapped in a burning building. The automatic cascading system used in FIG. 3 works in a substantially identical manner to the system illustrated in FIG. 1, other than using only a pair of storage cylinders 20 and 26, and only a single differential close sensing line 40 and a single differential pressure valve and air toggle switch combination 42 and 44. In addition, the storage cylinders 20 and 26 have been replaced in FIG. 3 with more mobile SCBA cylinders and the standard CGA fittings have been replaced with RIT fittings approved by the NFPA for rescue purposes. In addition, the fill/bleed valves used in FIG. 1, have been eliminated in FIG. 3.

The first rescue air storage cylinder 20 is connected through a universal CGA fitting 200, an inline bleed valve 202, a female RIT fitting 204, and a male RIT fitting 206, to a one-way check valve 60, as monitored by a pressure gauge 208. A differential valve close sensing line 40 is connected between the outlet of male RIT fitting 206 and a differential pressure valve 42 whose outlet is connected to the outlets, respectively, of the check valves 60 and 61, and also to the input of pressure regulator 70. The output of regulator 70 is connected through a restrictive orifice 71, as monitored by a pressure gauge 92, and then through an elongated flexible line 73 to a SCBA at location 76, which can be easily and safely connected/disconnected. A differential valve open sensing line 90 is connected downstream of restrictive orifice 71.

The second storage cylinder 26 is connected through the elements 300, 302, 304 and 306 to the inlet of the air toggle switch 44. Elements 300, 302, 304 and 306 correspond to elements 200, 202, 204 and 206, respectively, both as to construction and function.

In the operation of the system illustrated in FIG. 3, the following steps are used to rescue trapped firemen.

When personnel on SCBA is trapped, the RIT goes into operation to perform Stabilization/Rescue of the trapped individual. Since Technical Rescue of trapped individuals usually requires extended periods of time, proper air management is necessary. Also, in these high stress and possibly low visibility situations, special adoptions to the standard CAMS auto cascade is required. While some RIT members are working to free the trapped individual, others members are taking control of the air management situation. The following is a brief description of how the CAMS RIT Rescue Cascade would be used by RIT in this situation.

1—The trapped individual is located by RIT.

2—Rescue personnel carry in the RIT Rescue Cascade and set it up near the trapped individual.

3—Additional RIT members are carrying in spare SCBA cylinders which have the RIT/Rescue Male fittings.

4—Two of these cylinders are connected to the Rescue cascade incoming hose whips by use of the quick connect fittings.

5—The fill whip is then connected to the trapped individuals SCBA RIT/Rescue fitting.

NOTE: To simplify the use of this system in this high stress/low visibility situation, there are no fill/bleed valves to operate. These have been replaced by a flow restricting orifice 71 which will restrict/temporarily reduce the downstream pressure. However, if desired, a momentary toggle valve (on/off) can be upstream of the restricting oriface. This in turn will allow time for the pressure on sensing line 40 to close the differential pressure/toggle valve combination 42 and 44. Basically, this will permit the system to reset each time the fill whip RIT/Rescue fitting is connected to a different SCBA at location 76.

6—Pressure in the trapped individuals SCBA will equalize with that of SCBA cylinder 20. As these pressures come to approx. 125 psi of each other, the differential pressure/toggle valve combination 42 and 44 will open and permit the air from SCBA cylinder 26 to flow into and equalize with the trapped individuals SCBA at location 76.

To Use the RIT Rescue Cascade Subsequent Times, Follow the Procedure Below.

1—Disconnect from the trapped individuals SCBA RIT/Rescue fitting.

2—Disconnect SCBA cylinder 20 from the first stage of the RIT Rescue Cascade. (Send this cylinder to outside of the scene to be recharged)

3—Disconnect SCBA cylinder 26 from the second stage of the RIT Rescue Cascade then reconnect it to the first stage of the system.

4—Connect a new/fully charged SCBA cylinder to SCBA cylinder 26 second stage.

5—To begin filling/recharging, connect the fill whip RIT Rescue quick connect to the trapped individuals SCBA RIT/Rescue fitting.

NOTE: This process can be used for trapped individuals or RIT members SCBA during Rescue Operation.

Figure 4:
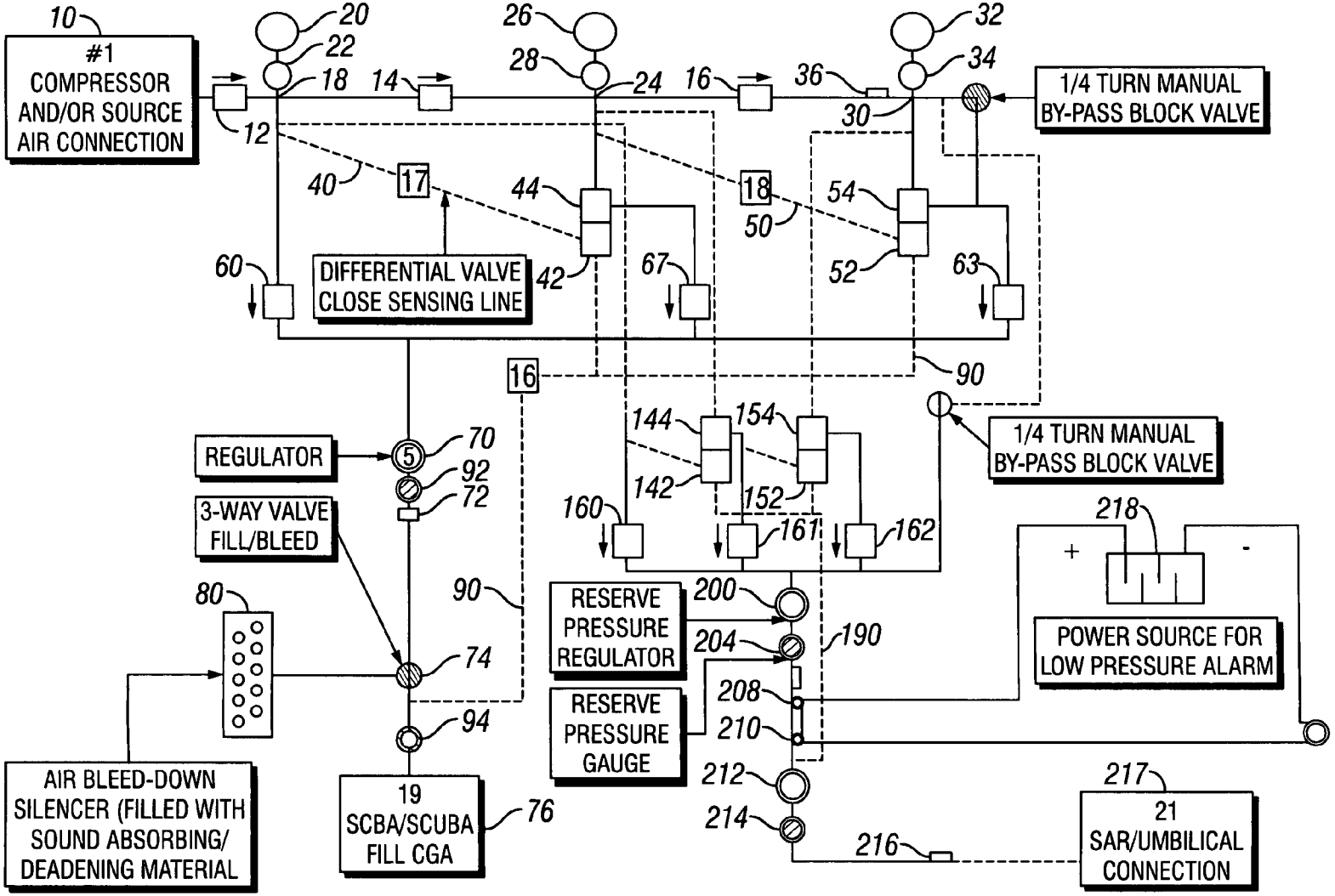
FIG. 4 is a block diagram of a fourth embodiment of the invention.

Referring now to FIG. 4, then is illustrated an alternative system according to the invention which combines some of the features according to FIG. 1 with some of the features according to FIG. 2, thus allowing for the simultaneous use of the features described with respect to FIGS. 1 and 2. Because the individual functions of the features of FIGS. 1 and 2, respectively, are essentially identical to the features of FIGS. 1 and 2 when combined, the functions of the simultaneous use of such functions require no additional description. However, where appropriate, the duplication of elements is shown by adding the digit "1" to the numbers. Thus, the corresponding check valves 60, 61 and 63 of FIGS. 1 and 2 are identified as valves 160, 161 and 163 in FIG. 4. The corresponding toggle air switches 44 and 54 are identified as switches 144 and 154. The differential pressure valves 42 and 52 are identified as valves 142 and 152. A differential valve open sensing line 190 is connected between the outputs of the valves 142 and 152, and the input to regulator 212 (corresponding to the regulator 112 of FIG. 2). It should be noted that when one of the numerals already has three digits with a first digit "1", as illustrated in FIGS. 1 and 2, the corresponding number in FIG. 4 changes the first digit to "2".

The invention claimed is:

1. A method for filling a plurality of compressed air storage cylinders with compressed air, comprising:

providing a source of compressed air;

connecting said source of compressed air, in a sequential manner, to a plurality of compressed air storage cylinders;

monitoring a pressure differential between at least a first of said compressed air storage cylinders and at least a second of said compressed air storage cylinders;

providing air from the source of compressed air to a first of said compressed air storage cylinders while preventing air from flowing to a second of said compressed air storage cylinders until the pressure differential reaches a selected maximum value; and permitting air from the source of compressed air, the first of said compressed air storage cylinders, or combinations thereof, to flow to the second of said compressed air storage cylinders after the pressure differential reaches the selected maximum value.

2. The method according to claim 1, wherein said source of compressed air comprises one or more air compressors and/or one or more compressed air tanks.

3. The method according to claim 1, further comprising the step of simultaneously providing air to the first of said compressed air storage cylinders and the second of said compressed air storage cylinders after the pressure differential reaches the selected maximum value.

4. A method for filling an individual air breathing tank from a plurality of compressed air storage cylinders, comprising:

providing a plurality of compressed air storage cylinders connected together in a sequential manner;

providing a fill station into which the air breathing tank to be filled is connected;

connecting the outputs of said compressed air storage cylinders to the fill station;

monitoring a pressure differential between at least a first of said compressed air storage cylinders and the air breathing tank;

automatically providing air from a first of said compressed air storage cylinders to the air breathing tank until the pressure differential reaches a selected minimum value; and automatically providing air from a second of said compressed air storage cylinders to the air breathing tank after the pressure differential reaches the selected minimum value wherein the step of monitoring the pressure differential between said at least a first of said compressed air storage cylinders and the air breathing tank comprises: monitoring the pressure differential between said at least a first of said compressed air storage cylinders and a sensing line in communication with the air breathing tank; and selectively isolating the sensing line, wherein the sensing line communicates solely with the air breathing tank such that pressure within the sensing line is maintained generally equal to pressure within the air breathing tank.

5. The method according to claim 4, wherein said individual air breathing tank is filled for use by a fireman.

6. The method according to claim 4, wherein said individual air breathing tank is filled for use by a SCUBA diver.

7. The method according to claim 4, wherein said at least one differential air pressure valve comprises a plurality of such valves.

8. The method according to claim 4, wherein the step of automatically providing air from a second of said compressed air storage cylinders to the air breathing tank after the pressure differential reaches the selected minimum value further comprises simultaneously providing air from the first of said compressed air storage cylinders to the air breathing tank after the pressure differential reaches the selected minimum value.

9. The method according to claim 4, further comprising the step of measuring the pressure of the air breathing tank while providing air to the breathing air tank.

10. A method for filling one or more individual air breathing tanks, comprising:

performing a back-fill operation comprising:

providing a plurality of compressed air storage cylinders connected together in a sequential manner in communication with a source of compressed air;

monitoring a first pressure differential between at least a first of said compressed air storage cylinders and at least a second of said compressed air storage cylinders;

providing air from the source of compressed air to a first of said compressed air storage cylinders while preventing air from flowing to a second of said compressed air storage cylinders until the first pressure differential reaches a selected maximum value; and permitting air from the source of compressed air, the first of said compressed air storage cylinders, or combinations thereof, to flow to the second of said compressed air storage cylinders after the first pressure differential reaches the selected maximum value; and performing an automatic filling operation comprising:

providing a fill station into which the one or more air breathing tanks to be filled are connected;

monitoring a second pressure differential between the first of said compressed air storage cylinders and a first of the air breathing tanks;

providing air from the first of said compressed air storage cylinders to the first of the air breathing tanks until the second pressure differential reaches a selected minimum value; and automatically providing air from the second of said compressed air storage cylinders to the first of the air breathing tanks after the second pressure differential reaches the selected minimum value.

11. The method according to claim 10, wherein said individual air breathing tanks are filled for use by one or more firemen.

12. The method according to claim 10, wherein said individual air breathing tanks are filled for use by one or more SCUBA divers.

13. The method according to claim 10, wherein said at least one differential air pressure valve comprises a plurality of such valves.

14. The method according to claim 10, wherein the backfill operation and the automatic filling operation are performed simultaneously.

* * * * *